US005890832A

United States Patent [19]

Soleau

[11] Patent Number: 5,890,832

[45] Date of Patent: Apr. 6, 1999

[54] METHOD AND APPARATUS FOR DEFLATING A TIRE OF A VEHICLE

[75] Inventor: Bert Soleau, Fairfax, Va.

[73] Assignee: Eagle Research Group, Inc., Arlington, Va.

[21] Appl. No.: 719,948

[22] Filed: Sep. 25, 1996

Related U.S. Application Data

[60] Provisional application No. 60/004,585 Sep. 29, 1995.

[51] Int. Cl.[6] ..... E01F 13/12

[52] U.S. Cl. ..... 404/6; 256/1; 49/131

[58] Field of Search ..... 404/6, 9–11; 49/49, 49/131–133; 256/1, 13.1

[56] References Cited

U.S. PATENT DOCUMENTS

| | | | |
|---|---|---|---|
| 4,097,170 | 6/1978 | Dickinson . | |
| 4,318,079 | 3/1982 | Dickinson . | |
| 4,382,714 | 5/1983 | Hutchison | 404/6 |
| 4,577,991 | 3/1986 | Rolow . | |
| 4,711,608 | 12/1987 | Ghusn . | |
| 5,253,950 | 10/1993 | Kilgrow et al. | 404/6 |
| 5,452,962 | 9/1995 | Greves . | |
| 5,482,397 | 1/1996 | Soleau . | |
| 5,498,102 | 3/1996 | Bissell . | |
| 5,507,588 | 4/1996 | Marts et al. . | |

FOREIGN PATENT DOCUMENTS

| | | |
|---|---|---|
| 2 603 921 | 3/1988 | France . |
| 2605 654 | 4/1988 | France . |
| 2 032 983 | 5/1980 | United Kingdom . |

*Primary Examiner*—James Lisehora
*Attorney, Agent, or Firm*—Oblon, Spivak, McClelland, Maier & Neustadt, P.C.

[57] ABSTRACT

A method and apparatus for deflating a tire of a vehicle, the apparatus including a housing having at least one channel member and at least one opening provided in the housing, and at least one deflator connected to the housing, an actuating cam slidably housed in the channel member and being removable from a first position to a second position, the cam engaging the at least one deflator when in the first position and respectively moving the at least one deflator into the at least one opening upon sliding of the cam from the first position to the second position so as to be engagable with a tire of a vehicle and a mechanism for sliding the cam in the channel member.

16 Claims, 6 Drawing Sheets

METHOD AND APPARATUS FOR DEFLATING A TIRE OF A VEHICLE

This application is based on provisional application serial number 60/004,585 filed Sep. 29, 1995.

BACKGROUND OF THE INVENTION

1. Field of the Invention

The present invention is directed to a method and apparatus for deflating the tire of a vehicle wherein an actuating cam slidably is slidably positioned in a housing and serves to engage at least one deflator connected to the housing.

2. Discussion of the Background

Deflators are known such as that described in U.S. Pat. No. 5,482,397, the disclosure of which is incorporated herein by reference. Tire deflators of this type include a mechanism for disabling vehicles which fail to stop at check points. Disabling such vehicles precludes high-speed chases which are dangerous to both police officers and to the general public. The tire deflator can be used at permanent facilities, e.g., U.S. customs inspection points as well as at improvised check points such as police road blocks or other locations where access by non-authorized personnel can be selectively prohibited. The spike utilized in this patent is permanently detachably mounted on its own support block of metal, plastic or other desirable material which, in turn, is mounted on the continuous base plate that provides support for a plurality of spikes. Each spike is attachable to a passage in the support block and the combined spike and support block is detachable as an integral unit from the base plate after tire penetration so as to remain attached to the tire after penetration of the tire by the spike.

Other traffic controllers are known such as that set forth in U.S. Pat. No. 4,097,170 that serve as devices to preclude wrong-way automobile traffic from entering exits of parking areas and the like. More particularly, a visible barrier is presented at the pavement level so as to permit the desired traffic flow by use of its depression when engaged by rolling tires, so as to cause or likely cause tire damage to an undesired reverse flow of traffic by use of its visible configuration of projecting members.

Heretofore, traffic directors or controllers of the type under consideration have often involved retractable spring arms and spikes assembled as a unit in a frame.

Durability of the traffic controllers can become a problem because the mechanisms causing projection of the spikes or their deflating members requires a plurality of movable elements, particularly where these movable elements are not provided with adequate support once the tire of the vehicle rolls over them. It is therefore desirable to have a tire deflator which is operable in a reliable manner and, upon operation, also provides support for the spike and permits the spike to both pierce the tire of the vehicle and be carried off by the tire, particularly in the instance where the spike is hollow, since this permits more rapid deflation of the tire.

It is also desirable to provide a tire deflator which has a minimum number of movable parts which are of sturdy construction and operate in a reliable manner despite adverse weather conditions and despite being exposed to not only the elements but also to dirt, sand and other gritty substances which are normally found on roads.

SUMMARY OF THE INVENTION

It is therefore an object of the present invention to provide a method and apparatus for deflating a tire of a vehicle which is operable in a reliable manner on a repeated basis and which provides adequate support for the deflator when such is traversed by the inflated tire of a vehicle. This subjects the tire deflator to a large concentrated amount of weight and thus adequate support of the tire deflator is necessary both for continual use of the tire deflator assembly and to make certain that, where desired, the deflator is removable from the housing so as to permit the deflator to more rapidly deflate the tire, such as where the deflator is in the form of a hollow spike.

It is a further object of the present invention to provide a single cam which can be utilized to activate all spikes arranged along the deflator assembly and to thus avoid the need for any rotating parts or bearings which are subjected to rotating loads.

It is a further object of the present invention to provide a cam having either a flat horizontal surface or a sloped surface such that, when deployed, the orientation of the spikes is normal to an surface of the cam since this is normally the desirable mode of operation.

It is a further object of the present invention to provide a hinge mechanism which effectively and reliably allows for pivoting of the support structure for the deflator. This may be in the form of a polymeric hinge that serves to provide a pivotable support for raising and lowering a steel cup within which the deflator is positioned to also receive the lateral loads and motion induced when the deflator is penetrating a tire without becoming permanently deformed so as to require replacement.

The invention also serves to provide a reliable support mechanism for the deflator, this preferably being in the form of a steel cup containing a spike support block and a deflator in the form of a spike which may be transferable to the tire when impacted by the tire. In addition it is preferably to constrain any lateral movement of the steel cup by the sides of the opening in a top plate of the housing through which the steel cup is deployed.

It is a further object of the present invention to utilize a deflator which can be effectively operable either when laid upon a flat surface or when placed in a trench formed in a surface so that the upper portion thereof is flat with the road surface.

An additional object or the present invention is to provide a tire deflator which can be operable by various mechanisms to provide a reliable force for shifting of the cam within the housing such as, for example, a mechanism which operates in a hydraulic, pneumatic or electrical manner and which can withstand repeated operation in a reliable manner while being subjected to the elements.

Lastly, a yet further object of the present invention is to retain the steel cup within which the deflator is positioned by the utilization of a retaining magnetic, a connecting member which utilized VELCRO or other type of retaining member to keep the steel cup reliably positioned on a side of the cam member when in a retracted state but which is releasable from the cam side surface upon activation of the cam.

DESCRIPTION OF THE PREFERRED EMBODIMENTS

Figure 1:
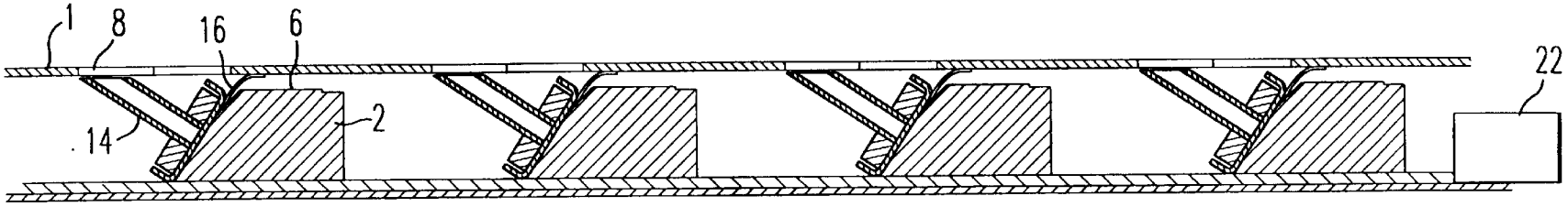
FIG. 1 is a cross-sectional view of the tire deflator as taken along line 1—1 of FIG. 4 wherein the tire deflator spikes are stored within the housing.
Figure 2:
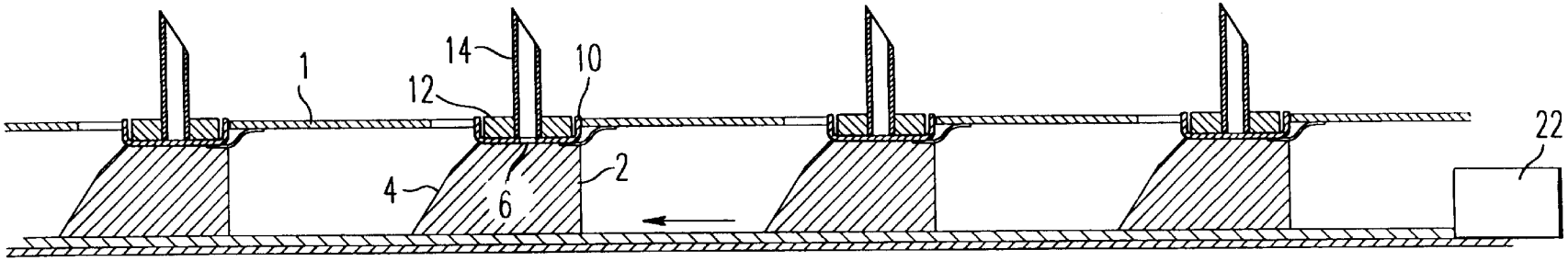
FIG. 2 is a cross-sectional view of the tire deflator upon activation of the cam mechanism so as to permit the tire deflator spikes to be properly deployed.
Figure 3:
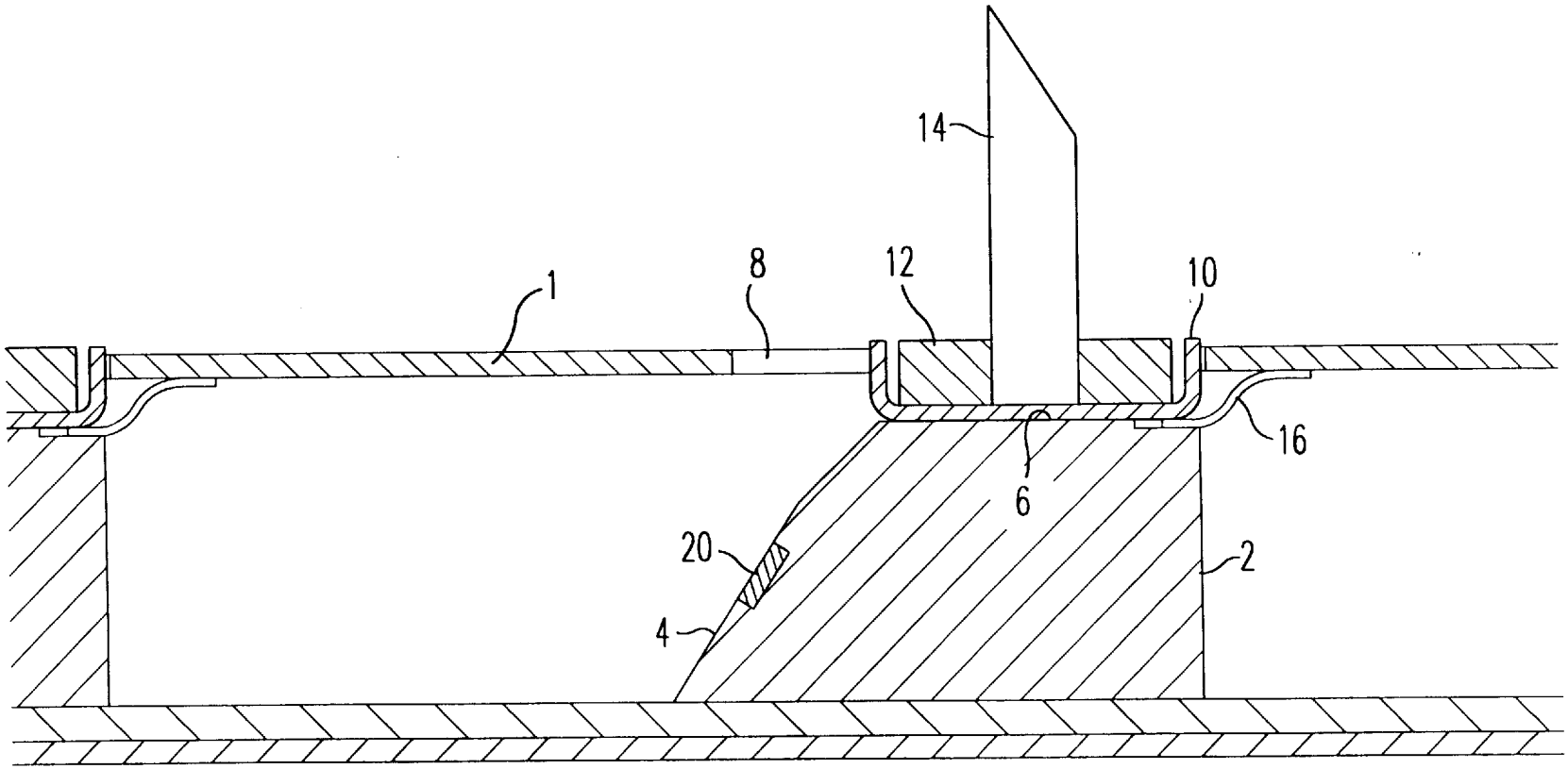
FIG. 3 shows a cross-sectional view on a enlarged scale more clearly illustrating a mechanism on the side of the cam for retaining the deflator in a retracted position, showing a hinge mechanism supporting the deflator as showing the manner in which the deflator is positioned in an opening in the housing when deployed.

FIGS. 1–6 serve to illustrate the first embodiment of the present invention. A housing 1 is provided so as to permit a cam 2 to be slidably mounted therein. More particularly, the plurality of cam members are interconnected as illustrated. Each cam has a sloped slide surface 4 and a top surface 6 which may be substantially flat or sloped so as to be parallel to the adjacent top surface of the housing 1. The housing is provided with multiple T-shaped openings 8.

Movably positioned on cam 2 is a steel cup 10 within which a spike support block 12 is positioned. The spike support block 12 has mounted thereon a spike which can be solid or can be made hollow if more rapid deflation of the vehicle tire is desired. The spike 14 is welded to the spike support block 12.

Each steel cup 10 is hinged to the housing 1 via a polymeric hinge although any other type of hinge operable in a similar manner is possible. A polymeric hinge has the advantage, however, of resisting permanent deformation and can be of a suitable composition so as to avoid rusting, splitting or other physical defects despite continued use in adverse weather conditions.

Figure 4:
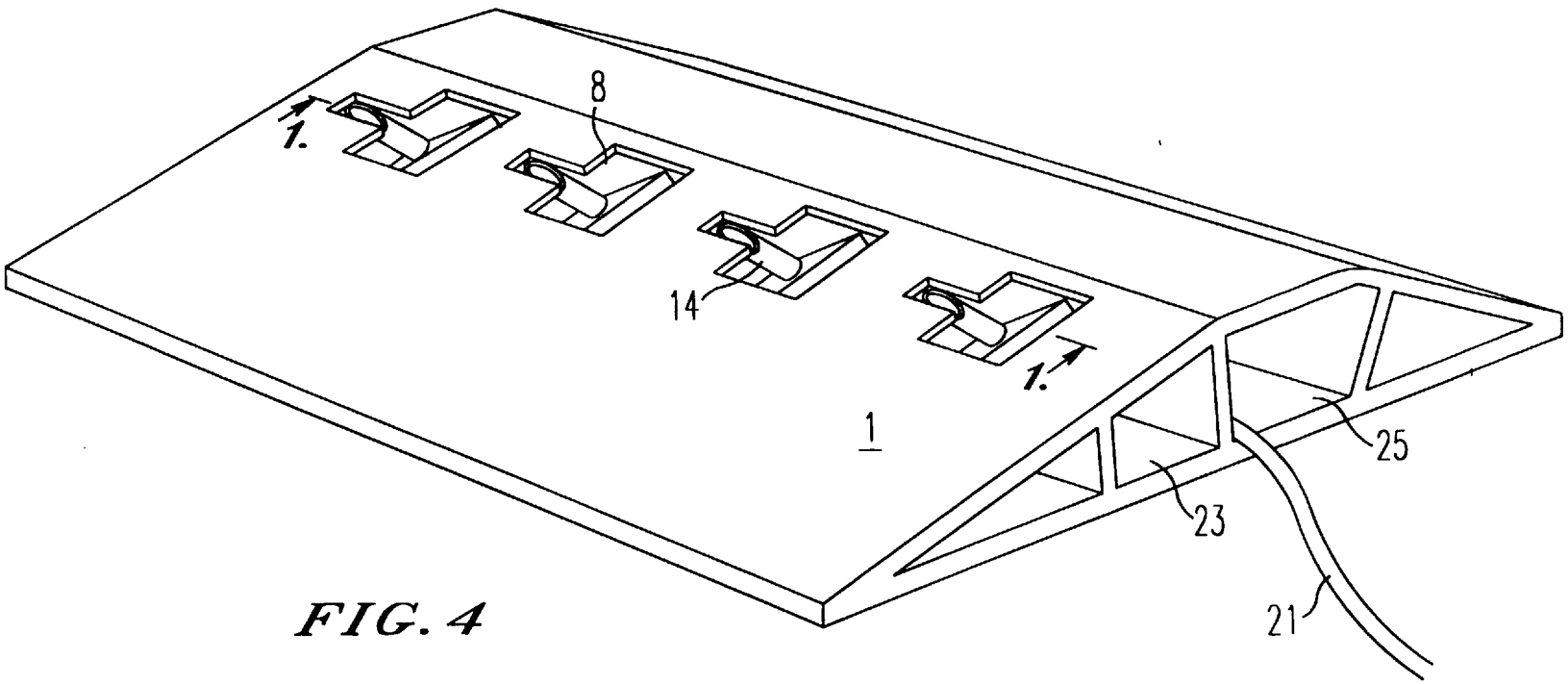
FIG. 4 shows a top, perspective view of the vehicle tire deflator of the type which is positionable on a substantially flat surface such as a road, parking lot or similar structure wherein the tire deflator spikes are retracted and which illustrates channels within which the cam is slidable.
Figure 5:
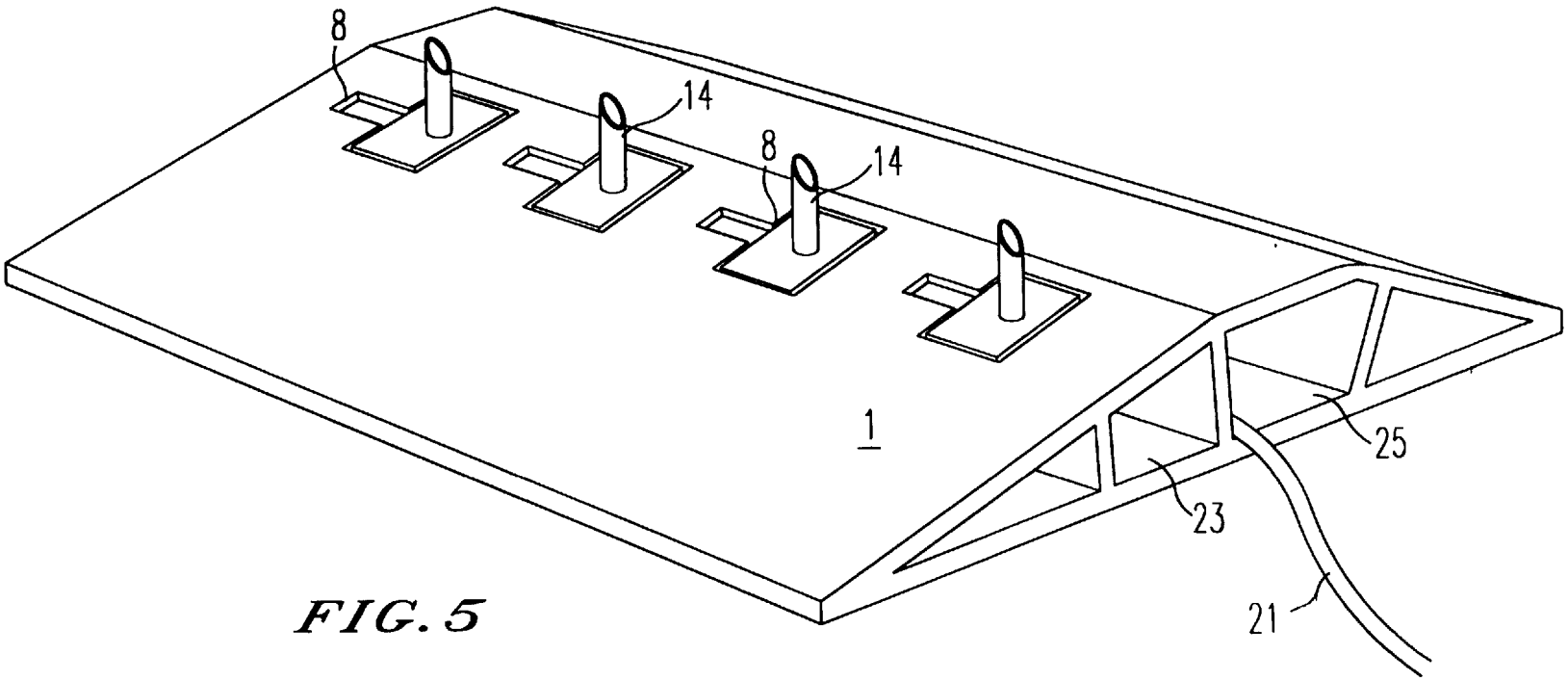
FIG. 5 is a view similar to that of FIG. 4 but wherein the tire deflator spikes are deployed.
Figure 6:
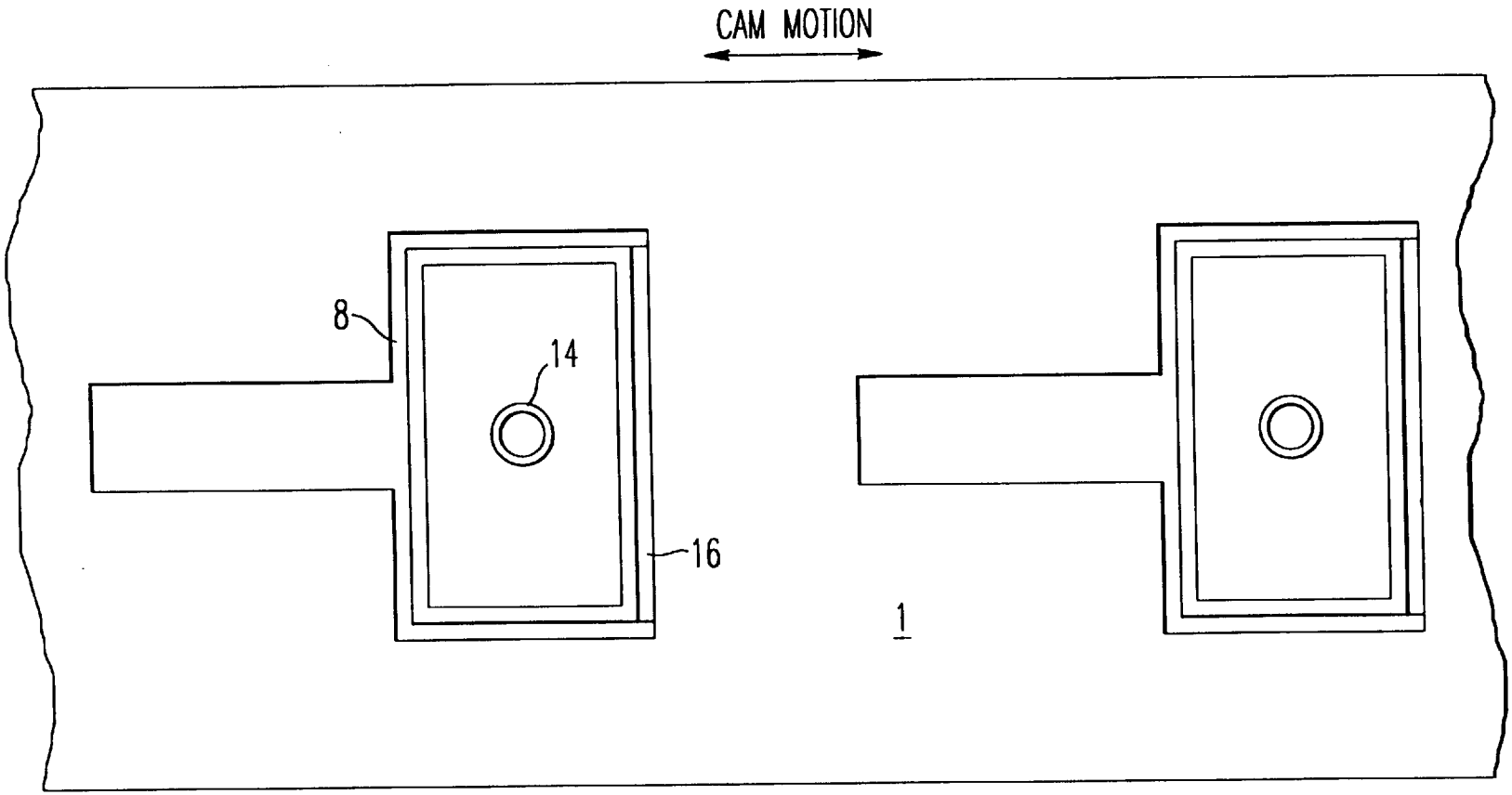
FIG. 6 is a view taken from above the tire deflator for the purpose of showing the location of the T-shaped opening in the housing, the location of the hinge mechanism and deflator support block and showing the clearance between the steel cup and the opening to permit limited movement of the cup upon being engaged by the tire of the vehicle.
Figure 7:
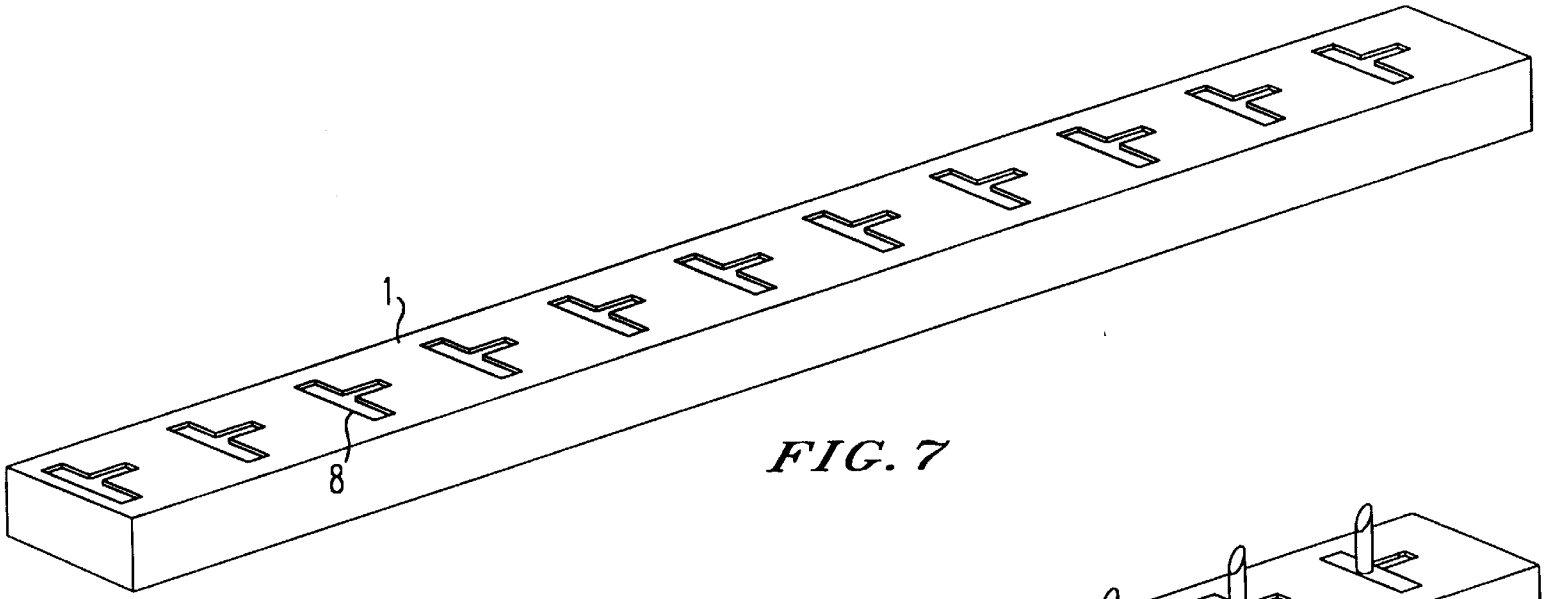
FIG. 7 shows a perspective view of a second embodiment of the tire deflator mechanism of the present invention which is positionable within a trench which would be dug within the road and showing the deflator spikes in a stowed position.
Figure 8:
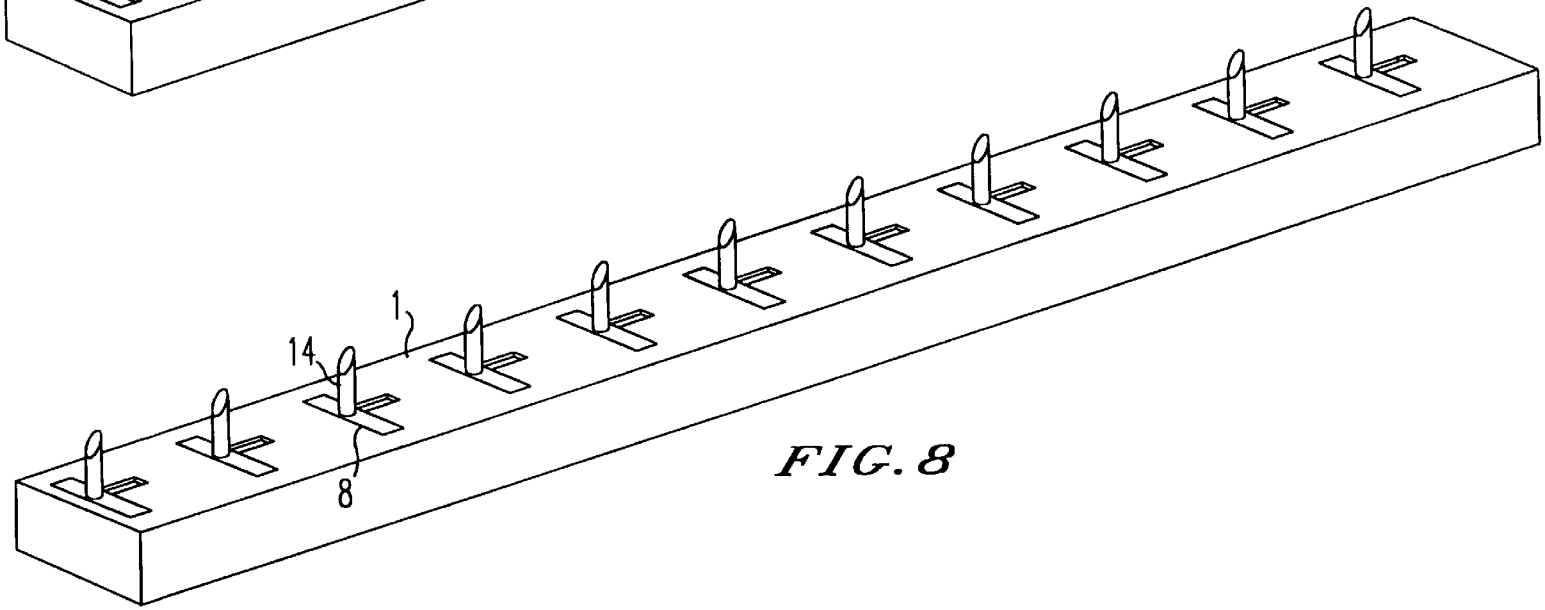
FIG. 8 is a view similar to that of FIG. 7 but showing the deflator spikes deployed.

In order to make certain that the steel cup is reliably maintained in position as shown in FIG. 1 when the spikes are stowed, a retaining member 20 is provided on cam 2 and comprises a magnet, a connector made of velcro or similar type of retainer. This retainer permits, however, sliding motion of the steel cup upon sliding motion of the cam 2. A mechanism 22 causing sliding motion of the cam 2 is also provided. This mechanism can be of any conventional type such as a hydraulic, pneumatic or electrical actuation mechanism. This can be located either within the housing or positioned outside thereof. Moreover, this can be located either above ground or below ground, depending upon the desire of the individual operating the deflator mechanism. Member 21 comprises a cable, fluid pressure conduit or hydraulic pressure conduit which is connected to a piston (not shown) extending from cam shifting mechanism 22 to permit the piston to move the cam 2. Member 21 is communicated to a conventional electrical source, fluid pressure source or compressed air source, depending upon which type of activation mechanism is to be utilized, which are external of the cam 2. As shown in FIGS. 4 and 5, the power supply cable can be fed down one of the channels provided in the deflator. It is to be understood, in addition, that the piston can be either located in the same channel 23 within which the cam 22 is located or can be provided in a parallel channel 25 with a slot provided in the wall of the channel for operation of the cam by the piston.

The advantages of the present invention are numerous and readily recognizable. More particularly, a single cam can be utilized for activating all spikes along the deflator unit. There is no need for rotating parts or bearings which might be subjected to rotating loads. Rather, the spikes are easily deployable and retractable and the cam can be designed so as to have a side portion cut at any angle desired to provide proper deployment of the spikes along the sloped surface thereof. Having the spike orientation normal to an inclined surface is desirable in many instances.

It is further noted that certain tolerances or spacings normally exist between the deployed steel cup and the opening into which it is fitted of the housing. This is helpful for reliable operation, particularly since the steel cup containing the spike support block and the spike will normally shift when impacted by a tire. Lateral movement of the steel cup is constrained by the size of the opening and the top plate portion of the housing through which the steel cup is deployed. The spike support block 12 and spike 14 can together rotate with the impaled tire. The spike may be replaced together with a new support block after being used to deflate the tire of the vehicle.

The functions of the polymeric hinge 16 are to (1) provide a pivotal support for raising and lowering the steel cup along with the spike support block and (2) to receive lateral loads and withstand motion induced when the spike is penetrating a tire without becoming permanently deformed and require replacement. One of the specific advantages of the sturdy cam mechanism in accordance with the present invention is that it is capable of withstanding large impact loads since it operates under a compression load. No components such as bearings, partially supported axles, etc. are needed and because of that, reliability, longevity and simplicity are characteristics of the present invention. As for the material utilized in the cam, DuPont Delrin can be utilized but other polymers or metals can also be used instead. A deflator apparatus of the present invention works both above ground or below ground in an effective manner.

The cam-actuated system in accordance with the present invention is also ideal for countering the forces exerted when a large spike impales the tire of a vehicle. While a hollow spike is contemplated as being the best type to use, other blades are devices could be substituted for the spikes and are within the scope of the present invention.

Obviously, numerous modifications and variations of the present invention are possible in light of the above teachings. It is therefore to be understood that within the scope of the appended claims, the invention may be practiced otherwise than as specifically described herein.

I claim:

1. A tire deflator, which comprises:

a housing having a plurality of openings formed therein;

a plurality of deflators connected to said housing;

a plurality of actuating cams slidably moveable by a longitudinally moveable member interconnecting the cams; the cams being housed in said housing and being slidably moveable from a first position to a second position, said cams respectively engaging said deflators when said cams assume said first position and respectively moving said deflators into said opening upon sliding of said cams from said first position to said second position so as to thereupon respectively project through the openings and be engagable with a tire of a vehicle; and a mechanism sliding said cams in said housing.

2. A tire deflator as claimed in claim 1, wherein said mechanism sliding said cams in said housing comprises one of a hydraulic mechanism, a pneumatic mechanism and an electrical mechanism.

3. A tire deflator as claimed in claim 2, which comprises a mechanism retaining said plurality of deflators on a side portion of said cams when said cams are in said first position.

4. A tire deflator as claimed in claim 1, wherein said deflators each comprise a hollow spike and a block member and wherein said spike is mounted on said block member.

5. A tire deflator as claimed in claim 1, wherein said openings in the housing each comprise a substantially T-shaped opening permitting passage of the deflators therethrough when said cams are in the second position.

6. The tire deflator as claimed in claim 1, wherein said cam has a sloped side surface with which the deflator is engaged when said cams are moved from said first position to said second position.

7. A tire deflator which comprises:

a housing having at least one opening formed therein;

at least one deflator connected to said housing;

an actuating cam slidably moveable by a longitudinally moveable member connected with the cam; the cam being housed in said housing and being movable from a first position to a second position, said cam engaging said deflator when said cam assumes said first position and moving said deflator into said opening upon sliding of said cam from said first position to said second position so as to thereupon project through the opening and be engagable with a tire of a vehicle; and a mechanism sliding said cam in said housing wherein said deflator comprises a cup, a support block positioned in said cup and a spike mounted on said support block.

8. A tire deflator as claimed in claim 7, wherein said cup is connected to said housing by a connecting device.

9. A tire deflator as claimed in claim 8, wherein said connecting device comprises a hinge.

10. A tire deflator as claimed in claim 9, wherein said hinge comprises a strap.

11. A tire deflator as claimed in claim 7, wherein said cup is slidable on a surface portion of said cam.

12. A tire deflator, which comprises:

a housing having at least one opening formed therein;

at least one deflator connected to said housing;

an actuating cam slidably moveable by a longitudinally moveable member connected with the cam; the cam being housed in said housing and being moveable from a first position to a second position, said cam engaging said deflator when said cam assumes said first position and moving said deflator into said opening upon sliding of said cam from said first position to said second position so as to thereupon project through the opening and be engagable with a tire of a vehicle; and a mechanism sliding said cam in said housing wherein said cam comprises a support structure supporting said deflator when said cam is in the second position and said deflator is located in said housing when being stowed, said support structure also supporting a tire of a vehicle when the tire engages the deflator and permitting effective penetration of the tire by the deflator.

13. A method of deflating a tire of a vehicle, which comprises:

positioning a plurality of slidable cams in a housing having a plurality of openings formed therein;

mounting a plurality of deflators in the housing so as to be respectively engagable with the cams;

interconnecting the cams so as to be longitudinally moveable together; and sliding the cams within the housing so as to simultaneously move the deflators from a first position within the housing to a second position projecting from the housing and to respectively move said deflators through said openings upon being moved from the first position of the deflators to the second position of the deflators.

14. A method of deflating a tire as claimed in claim 13, wherein upon sliding of the cams, said deflators respectively slide along a surface portion of the cam, said cams supporting said deflators when in the second position and permitting deflation of the tire of the vehicle upon passing of the tire over the deflator.

15. A method of deflating a tire as claimed in claim 13, which comprises hinging the deflators to the housing prior to sliding the cams in the housing.

16. A method of deflating a tire as claimed in claim 13, which comprises respectively retaining the deflators on the cams when the deflators are in the first position.

* * * * *